United States Patent [19]

Gautier

[11] 4,263,588

[45] Apr. 21, 1981

[54] HELMET-CARRIED APPARATUS FOR DETECTING AND SIGNALLING THE PRESENCE OF A DANGEROUS GAS IN AN ATMOSPHERE

[75] Inventor: Alain L. Gautier, Arras, France

[73] Assignee: Oldham France S.A., France

[21] Appl. No.: 60,332

[22] Filed: Jul. 25, 1979

[51] Int. Cl.[3] ..... G08B 17/10; F21L 15/14

[52] U.S. Cl. ..... 340/632; 340/321; 340/331; 340/366 A; 340/633; 340/693; 362/106; 422/96

[58] Field of Search ..... 340/632, 633, 634, 321, 340/573, 693, 586, 366 A, 331; 362/103, 105, 106; 324/133; 422/96

[56] References Cited

U.S. PATENT DOCUMENTS

| | | | |
|---|---|---|---|
| 1,584,276 | 5/1926 | Coulter | 340/321 |
| 1,757,887 | 5/1930 | Wheat | 362/106 |
| 3,201,771 | 8/1965 | Proulx | 340/586 |
| 3,309,691 | 3/1967 | Bonanno | 362/106 X |
| 3,676,664 | 7/1972 | Corvetti | 362/105 |
| 3,788,124 | 1/1974 | Teton | 340/632 X |
| 3,815,114 | 6/1974 | Johnson et al. | 340/633 X |
| 4,090,185 | 5/1978 | Patty | 340/366 A |
| 4,090,232 | 5/1978 | Golden | 362/106 |
| 4,146,887 | 3/1979 | Magnante | 340/633 X |

FOREIGN PATENT DOCUMENTS

| | | | |
|---|---|---|---|
| 2418622 | 10/1975 | Fed. Rep. of Germany | 324/133 |

*Primary Examiner*—John W. Caldwell, Sr.
*Assistant Examiner*—Daniel Myer

[57] ABSTRACT

Apparatus for detecting and signalling the presence of a dangerous gas in an atmosphere comprising means for detecting the gas and means for signalling when the gas content exceeds a predetermined level. Said detecting means and said signalling means are disposed in a common housing and connecting by a double-wire cable to a separate supply.

6 Claims, 3 Drawing Figures

HELMET-CARRIED APPARATUS FOR DETECTING AND SIGNALLING THE PRESENCE OF A DANGEROUS GAS IN AN ATMOSPHERE

DESCRIPTION

The present invention relates to apparatus for detecting the presence of dangerous gases in mine galleries and for signalling the danger of such a gas when the concentration thereof in the atmosphere of a mine reaches a predetermined level.

Many detecting and signalling devices are known among which may be mentioned bridge detectors whose sensitivity corresponds to safety standards which are set for the mines of countries of Western Europe.

An object of the invention is to provide a measuring and signalling apparatus, which is sometimes termed a "firedampscope" lamp which, while it has a performance which satisfies the existing standards, is particularly easy to use and relatively simple in construction and permits rendering the equipment of the miner lighter.

According to the invention, there is provided an apparatus for detecting and signalling the presence of a dangerous gas in an atmosphere, comprising means for detecting said gas and means for signalling when the content of the gas exceeds a predetermined level, wherein said detecting means and said signalling means are disposed in a common housing and are connected by a double-wire cable to a separate supply.

Further features of the invention will be apparent from the ensuing description.

In the accompanying drawings, which are given solely by way of example:

Figure 1:
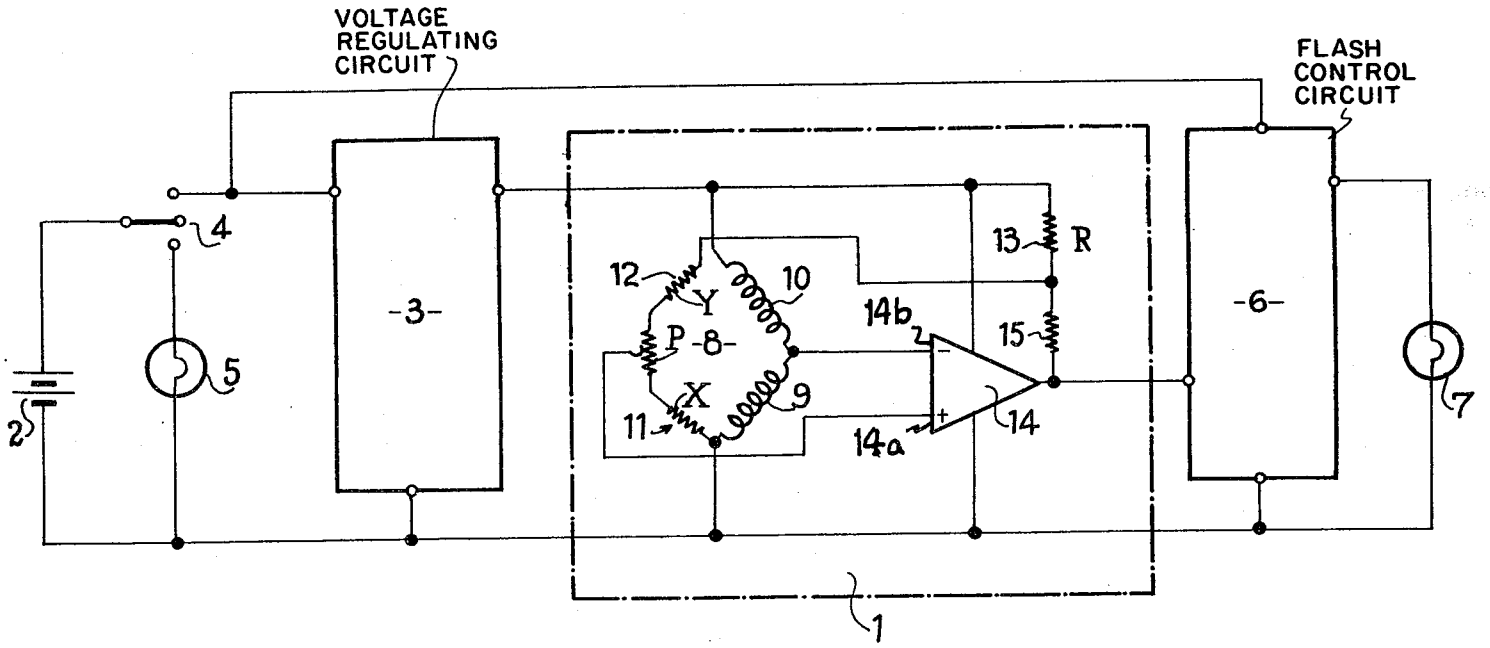
FIG. 1 is an electric diagram of the detecting and signalling apparatus according to the invention.

The circuit shown in FIG. 1 comprises a detector and trigger unit 1, defined by a rectangle in dot-dash lines and supplied with power by a DC supply 2 constituted, for example, by a lead accumulator battery or a cadmium-nickel battery through a voltage regulating circuit 3.

The regulating circuit 3 is connected to the battery 2 through a switch 4 having three contact positions.

A dim lamp 5 is connected to one of said contact positions of the switch.

Connected to the output of the detector and trigger unit 1, is a circuit 6 for controlling the flashing of a lamp 7, this lamp also performing the function of an illuminating lamp.

The detector and trigger circuit 1 comprises a Wheatstone bridge 8 whose branches 9 and 10 are constituted by a detector filament and a compensating filament respectively. The other two branches 11 and 12 of the bridge 8 comprise a resistor X and Y respectively and a part of a potentiometer P whose slide constitutes the terminal of the diagonal of the bridge. Also connected in the branch 12 is a resistor 13 which is in series with the resistor Y and has a value $R=X-Y$.

Connected across the diagonal part of the bridge 8 by its two inputs is an operational amplifier 14 having a positive input $14^a$, a negative input $14^b$ and an output $14^c$ which constitutes the output of the circuit 1 and is connected to the input of the control circuit 6.

The resistor 13 is moreover part of a voltage-divider which also comprises a resistor 15 which is connected between the output of the amplifier 14 and the junction point of the resistors 12 and 13.

The flash controlling circuit 6 is an astable multivibrator circuit which is adapted to intermittently cut off the supply current of the illuminating lamp 7.

Thus it can be seen that the device, whose electric circuit is shown in FIG. 1 and whose operation will be described in detail hereinafter, performs the double function of a normal illumination and the signalling of an excess of gas in the surrounding atmosphere.

The Applicant has incorporated this device in one and the same unit.

Figure 2:
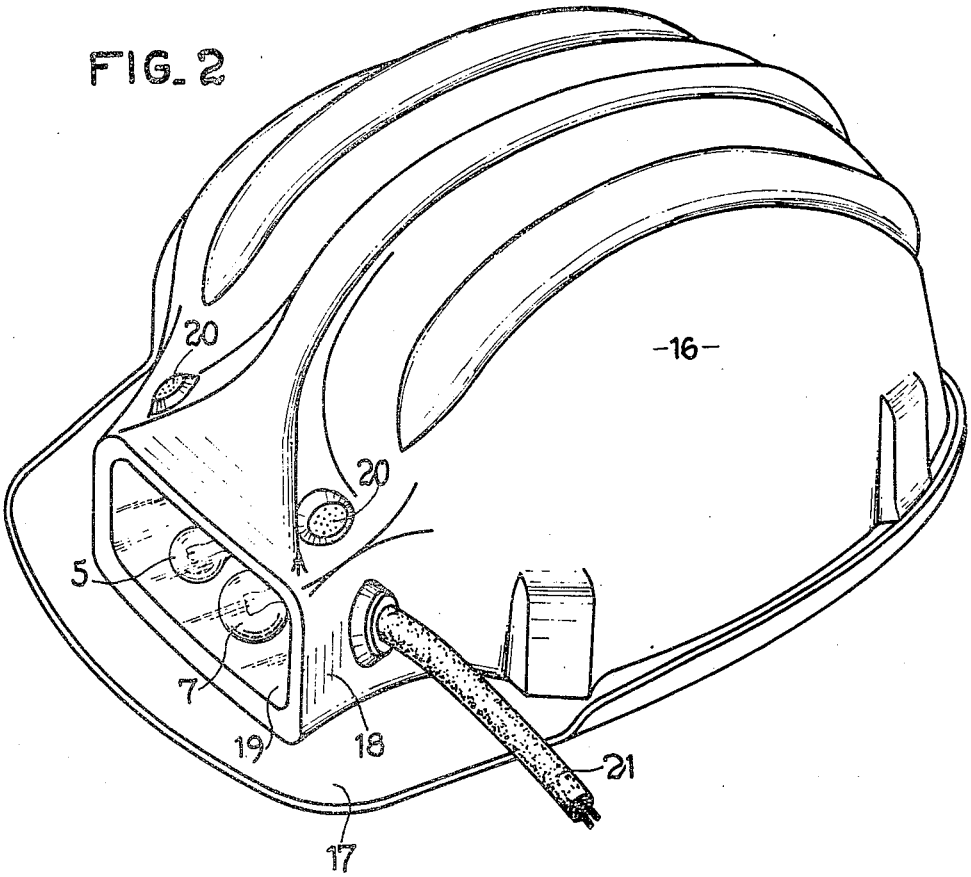
FIG. 2 is a perspective view of a helmet in which the apparatus of the invention is incorporated.

In FIG. 2, there is shown a helmet 16 which comprises, above its vizor 17, a housing 18 which is moulded therewith.

In its inner part, the housing 18 is provided with a window 19 through which can be seen the illuminating lamp 7 and the dim lamp 5 of the circuit of FIG. 1.

According to a particular feature of the invention, the whole of the circuit of FIG. 1, apart from the battery 2, is disposed in the housing 18 which has a sealed region containing the lamps 5 and 7 and a region for receiving the gas which contains the filaments 9 and 10 of the detector. The gas-receiving region is put in communication with the exterior by way of passageways 20 of sintered metal.

The circuit contained in the housing 18 is supplied with current by the battery (not shown) through a double-wire cable 21.

The double-wire connection between the battery and the helmet containing the detecting and signalling circuit is an important feature of the invention.

Figure 3:
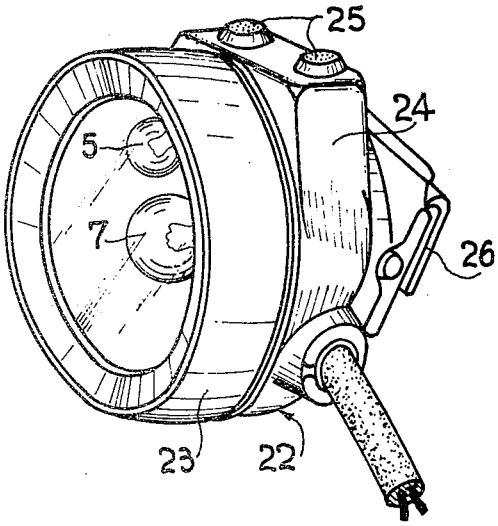
FIG. 3 is a view of another embodiment of the apparatus according to the invention.

The apparatus shown in FIG. 3 comprises all of the elements of the circuit of FIG. 1 but, instead of being incorporated in a helmet, it is disposed in a separate housing 22 which is provided in the front part with a sealed compartment 23 in which the dim lamp 5 and illuminating lamp 7 are disposed and a compartment 24 which communicates with the surrounding atmosphere by way of passageways 25 and contains the whole of the electronic circuit.

The housing has a system 26 for securing it to a helmet or other means.

The apparatus of FIG. 3 in fact has the appearance of a conventional miner's lamp, but the detecting and signalling means essential to the work carried out in a firedamp atmosphere are associated with this lamp.

The operation of the device shown in FIG. 1 will now be described.

When the switch 4 is placed in its lower contact position shown in FIG. 1, the dim lamp 5 is the sole element of the device which is connected to the battery 2. It therefore supplies a light of low intensity and the rest of the device is inoperative.

When the switch 4 is placed in its upper contact position the whole of the device is put in circuit and the supply of the lamp 5 is cut off.

In a normal atmosphere, the lamp 7 is directly supplied with current by the battery 2 and provides a normal continuous illumination.

As concerns the detecting bridge 1 which is supplied with current by the voltage regulator 3, it constantly measures the content of, for example, methane in the surrounding atmosphere.

The resistors 13, 12, 11 and the potentiometer P form a voltage divider which is connected between the terminals of the regulator 3.

The potentiometer P consequently permits a modification of the value of the reference voltage of the divider and consequently the threshold of actuation of the device, that is to say its sensitivity to the content of gas in the surrounding atmosphere.

The filaments 9 and 10 are in contact with the atmosphere containing the gas to be detected, but only the filament 9 heats in the presence of the gas.

The filament 10 has for sole purpose to compensate for variations in the surrounding humidity, pressure and temperature.

In the absence of gas, the potential at the terminals of the filament 10 is equal to that across the terminals of the filament 9.

The potential of the + input $\mathbf{14}^a$ of the amplifier 14 is higher than the potential at its − input $\mathbf{14}^b$.

When the filament 9 heats in the presence of gas, its resistance increases and the voltage at the − input $\mathbf{14}^b$ of the amplifier 14 increases.

The output potential of the amplifier 14 remains positive until the potential at its − input $\mathbf{14}^b$ becomes higher than the potential at its + input $\mathbf{14}^a$.

Then the output potential of the amplifier 14 becomes negative and introduces in the resistor 13 of value R a voltage drop which is a function of R and of the value K of the resistor 15.

This modification results in a drop in the potential at the + input $\mathbf{14}^a$ of the amplifier 14 which actuates the multivibrator 6.

The latter modulates the supply of current to the lamp 7. The resulting flash frequency is such that it does not bother the bearer of the lamp owing to the short duration of the non-illuminating period.

Tests carried out have shown that the apparatus according to the invention has a precision higher than ±0.1% of $CH_4$.

The supply battery 2 of the apparatus, which battery is placed on the belt of the user, may be advantageously a battery of the "T" type (OLDHAM 13 Ah) which has a life similar to that of conventional miner hat lamps.

In the embodiments just described, the signalling is effected by a flashing of a lamp. However, it will be understood that this signalling may be effected by any other means such as a transmitter of vibrations via the bone structure which is placed on the helmet in the region of the mastoid bone of the user.

Having now described our invention what we claim as new and desire to secure by Letters Patent is:

1. A structure comprising a helmet, an illuminating lamp including an electric bulb for casting a continuous beam of light in front of the user of the helmet, a housing enclosing said illuminating lamp and carried by the helmet, an electric power supply separate from the housing and helmet and intended and adapted to be carried by a part of the body of the user of the helmet other than the head of the user, connecting means including a two-wire cable connecting the supply to the bulb of the illuminating lamp, and an electric apparatus for detecting and signalling the presence of a dangerous gas in an atmosphere in the environment of the helmet, said apparatus comprising an electric circuit including means for detecting when the content of said gas in the atmosphere exceeds a predetermined threshold value and electric signalling means connected to be responsive to the detecting means, said apparatus being entirely enclosed in said housing, said circuit being connected to said supply through said two-wire cable, and aperture means in said housing for putting said detecting means in communication with said atmosphere.

2. A structure comprising a helmet, an illuminating lamp including an electric bulb for casting a continuous beam of light in front of the user of the helmet, a housing enclosing said illuminating lamp and carried by the helmet, an electric power supply separate from the housing and helmet and intended and adapted to be carried by a part of the body of the user of the helmet other than the head of the user, connecting means including a two-wire cable connecting the supply to the bulb of the illuminating lamp, and an electric apparatus for detecting and signalling the presence of a dangerous gas in an atmosphere in the environment of the helmet, said apparatus comprising an electric circuit including means for detecting when the content of said gas in the atmosphere exceeds a predetermined threshold value and electric signalling means connected to be responsive to the detecting means, said apparatus being entirely enclosed in said housing, said circuit being connected to said supply through said two-wire cable, and aperture means in said housing for putting said detecting means in communication with said atmosphere, said signalling means being light signalling means which comprise said bulb so that said bulb has two separate functions, namely an illuminating function and a signalling function, said signalling means further comprising flash-producing means inserted in said circuit for modulating the supply of power to said bulb by at least a reduction in said supply at intervals at a predetermined rate, and trigger means interposed between said flash-producing means and said detecting means and directly connected to the detecting means so as to trigger said flash-producing means upon detection of said gas by said detecting means.

3. A structure as claimed in claim 2, wherein said detecting means comprise a measuring bridge having at least one branch which comprises a catalytic detecting filament for detecting the presence of said gas, a voltage regulator inserted in said connecting means between the measuring bridge and said supply, the measuring bridge comprising a comparator having two inputs which are connected to a terminal of a diagonal portion of the measuring bridge, the comparator having an output which is connected to the flash-producing means.

4. A structure as claimed in claim 2 or 3, wherein said flash-producing means comprise a multivibrator circuit.

5. A structure as claimed in claim 1, 2 or 3, wherein said housing comprises a compartment which is sealed from said gas and contains at least said illuminating bulb and a compartment which communicates with the atmosphere by way of said aperture means and contains at least said detecting means.

6. A structure as claimed in claim 5, wherein said housing is an integral part of the helmet.

* * * * *